US007852367B2

(12) United States Patent
Shinotou

(10) Patent No.: US 7,852,367 B2
(45) Date of Patent: Dec. 14, 2010

(54) SUBLIMATIC LASER PRINTER

(75) Inventor: Hidenari Shinotou, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 599 days.

(21) Appl. No.: 11/857,461

(22) Filed: Sep. 19, 2007

(65) Prior Publication Data

US 2008/0252715 A1 Oct. 16, 2008

(30) Foreign Application Priority Data

Oct. 23, 2006 (JP) ..... 2006-287914

(51) Int. Cl.
*B41J 2/435* (2006.01)

(52) U.S. Cl. ..... 347/262

(58) Field of Classification Search ..... 347/262–264
See application file for complete search history.

(56) References Cited

U.S. PATENT DOCUMENTS 5,264,867 A * 11/1993 DeCook et al. ..... 347/262
5,266,969 A 11/1993 Mochizuki
5,530,468 A * 6/1996 Yoshimi et al. ..... 347/262
5,611,629 A 3/1997 Paranjpe
5,718,523 A 2/1998 Shiina et al.
5,764,245 A * 6/1998 Yokoi ..... 347/16
2002/0080221 A1 6/2002 Aronco

FOREIGN PATENT DOCUMENTS

| | | | |
|---|---|---|---|
| EP | 0 770 492 A1 | | 5/1997 |
| JP | 58171977 A | * | 10/1983 |
| JP | 7-171992 A | | 7/1995 |
| JP | 8-174871 A | | 7/1996 |
| JP | 8-290594 A | | 11/1996 |
| JP | 2005-503275 A | | 2/2005 |
| WO | WO 02/051640 A2 | | 7/2002 |

OTHER PUBLICATIONS

Extended European Search Report dated Jan. 8, 2008 (Five (5) pages).

* cited by examiner

*Primary Examiner*—Charlie Peng
(74) *Attorney, Agent, or Firm*—Crowell & Moring LLP

(57) ABSTRACT

This printer includes a print head portion having a laser application portion emitting a laser beam, for performing printing by applying the laser beam from the laser application portion in a state bringing an ink sheet and a paper into contact with each other while transporting the ink sheet in a first direction and transporting the paper in both of the first direction and a second direction opposite to the first direction.

14 Claims, 6 Drawing Sheets

SUBLIMATIC LASER PRINTER

BACKGROUND OF THE INVENTION

1. Field of the Invention

The present invention relates to a printer, and more particularly, it relates to a printer comprising a print head portion capable of emitting a laser beam.

2. Description of the Background Art

A printer comprising a print head portion capable of emitting a laser beam is known in general. Such printers are disclosed in Japanese Patent Laying-Open Nos. 08-290594 (1996), 08-174871 (1996) and 07-171992 (1995) and National Patent Publication Gazette No. 2005-503275, for example.

Each of the printers disclosed in the aforementioned Japanese Patent Laying-Open Nos. 08-290594 and 08-174871 is so formed as to apply a laser beam to an ink sheet superposed on a paper and wound on a rotating drum along with the paper.

In each of the printers disclosed in the aforementioned Japanese Patent Laying-Open Nos. 08-290594 and 08-174871, however, the ink sheet remains wound on the rotating drum still in close contact with the paper in a non-printing state, whereby the ink of the ink sheet disadvantageously slightly adheres to the overall paper due to the contact between the ink sheet and the paper over a long period.

In order to solve the aforementioned problem, Japanese Patent Laying-Open No. 07-171992 proposes a technique capable of inhibiting the ink of an ink sheet from slightly adhering to the overall paper.

The aforementioned Japanese Patent Laying-Open No. 07-171992 discloses a sublimatic laser printer comprising a bobbin (cartridge) dedicated to an ink sheet so that the ink sheet may not be superposed on a paper over a long period, for bringing the ink sheet into contact with the paper at an extremely small width with a semi-columnar transparent press bar and sublimating the ink with a laser beam thereby preventing the ink from slightly adhering to the overall paper.

A printing system capable of thermally transferring a signature required by a substrate such as a credit card from a thermal foil member brought into pressure contact with the substrate to the substrate with a laser beam is also known in general, as disclosed in the aforementioned National Patent Publication Gazette No. 2005-503275.

However, the sublimatic laser printer disclosed in the aforementioned Japanese Patent Laying-Open No. 07-171992 simultaneously moves the ink sheet and the paper brought into contact with each other by the press bar in the same direction (first direction) for transferring the ink from the ink sheet to the paper. When performing printing by successively transferring inks from ink sheets of three colors of Y (yellow), M (magenta) and C (cyan) to the paper, therefore, the sublimatic laser printer must transport the paper in a second direction opposite to the aforementioned first direction for returning the same to the original printing start position every time the paper is printed with one of the three colors, whereby the number of times for transporting the paper in printing is disadvantageously increased.

The printing system described in the aforementioned National Patent Publication Gazette No. 2005-503275 transfers the signature to the substrate with a pressure and heat, to disadvantageously require a pressurization mechanism for applying a pressure in addition to the laser beam serving as a heat source.

SUMMARY OF THE INVENTION

The present invention has been proposed in order to solve the aforementioned problems, and an object of the present invention is to provide a printer capable of reducing the number of times for transporting a paper in printing while preventing the paper from adhesion of an ink resulting from contact between an ink sheet and the paper over a long period, with no requirement for a pressurization mechanism in printing.

A printer according to a first aspect of the present invention comprises a printer body mountable with an ink sheet cartridge for storing an ink sheet, a print head portion, provided on the printer body, including a laser application portion emitting a laser beam from a position separated from a paper and the ink sheet at a prescribed interval for applying heat to the ink sheet thereby transferring the ink to the paper and a feed roller for transporting the paper, for performing printing by applying the laser beam from the laser application portion in a state bringing the ink sheet and the paper into contact with each other while transporting the ink sheet in a first direction and transporting the paper in both of the first direction and a second direction opposite to the first direction in plan view.

In the printer according to the first aspect, as hereinabove described, the printer body is rendered mountable with the ink sheet cartridge for storing the ink sheet so that the ink sheet and the paper can be separately put on standby in a nonprinting state, whereby the ink sheet and the paper do not remain in contact with each other over a long period, and the ink can be prevented from slightly adhering to the overall paper. Further, the printer comprising the print head portion including the laser application portion emitting the laser beam from the position separated from the paper and the ink sheet at the prescribed interval can apply heat without bringing the print head portion into contact with the ink sheet, to require no pressurization mechanism for applying a pressure in addition to the laser beam serving as a heat source. In addition, the printer comprises the feed roller for transporting the paper and is so formed as to perform printing by applying the laser beam from the laser application portion in the state bringing the ink sheet and the paper into contact with each other while transporting the ink sheet in the first direction and transporting the paper in both of the first direction and the second direction opposite to the first direction in plan view, to be capable of continuously performing printing by successively transporting the paper in the first and second directions when successively transferring inks from ink sheets of three colors of Y (yellow), M (magenta) and C (cyan). Thus, the printer may not transport the paper in the second direction opposite to the aforementioned first direction for returning the same to the original printing start position every time the paper is printed with one of the three colors dissimilarly to a case of performing printing by transporting the paper only in the first direction, whereby the number of times for transporting the paper in printing can be reduced.

In the aforementioned printer according to the first aspect, the ink sheet cartridge preferably includes a first guide portion for guiding the ink sheet to come into contact with the paper and a second guide portion for guiding the paper to come into contact with the ink sheet. According to this structure, the ink sheet and the paper can be brought into contact with each other regularly on a constant position.

In this case, the printer preferably further comprises a platen roller for guiding the paper along with the second guide portion, while the platen roller is preferably so formed as to come into contact with the rear surface of the paper opposite to the front surface of the paper coming into contact with the ink sheet. According to this structure, the platen roller can prevent the paper from moving in a direction for separating from the ink sheet, thereby reliably bringing the ink sheet into contact with the paper.

In the aforementioned structure having the ink sheet cartridge including the first guide portion and the second guide portion, a surface of the second guide portion coming into contact with the paper preferably has a substantially planar shape. According to this structure, the paper is so guided as to come into contact with the ink sheet through the substantially planar surface of the second guide portion, whereby the second guide portion can guide the paper in a state as planar as possible without creasing the same.

In the aforementioned structure having the ink sheet cartridge including the first guide portion and the second guide portion, the first guide portion and the second guide portion of the ink sheet cartridge preferably include slit openings for passing the laser beam therethrough respectively. According to this structure, the laser beam can be directly applied to the ink sheet through the slit openings, thereby easily transferring the ink to the paper by applying heat to the ink sheet and sublimating the ink.

In this case, the first guide portion is preferably so formed as to extend into the slit opening of the second guide portion. According to this structure, the ink sheet is guided by the first guide portion into the slit opening of the second guide portion, to come into contact with the paper in the slit opening of the second guide portion.

In the aforementioned structure having the ink sheet cartridge provided with the first guide portion and the second guide portion including the slit openings respectively, the ink sheet is preferably so guided by the first guide portion as to protrude toward the paper and come into contact with the paper in the slit opening of the second guide portion. According to this structure, the ink sheet so protrudes as to approach the paper in the slit opening of the second guide portion, thereby easily coming into contact with the paper in the slit opening of the second guide portion.

In the aforementioned printer according to the first aspect, the print head portion preferably includes a condenser lens for condensing the laser beam and a lens driving portion for controlling the focus of the laser beam. According to this structure, the size of the laser beam spot can be varied by driving the condenser lens, thereby varying the size of the sublimated ink. Thus, the room for printing representation can be spread for performing high-definition printing.

The aforementioned printer according to the first aspect preferably further comprises a head driving portion provided on the printer body for moving the print head portion in a direction perpendicular to the first and second directions for transporting the paper in plan view. According to this structure, the printer can apply the laser beam while moving the print head portion in the direction perpendicular to the first and second directions for transporting the paper in plan view, thereby performing printing also in the direction perpendicular to the directions for transporting the paper in plan view with the single laser application portion.

In the aforementioned printer according to the first aspect, the ink sheet is preferably formed by successively connecting at least three sheets including a first sheet, a second sheet and a third sheet, and the paper is preferably transported in the first direction to be introduced into the printer body in plan view and printed with the first sheet and the third sheet, and transported in the second direction, opposite to the first direction in plan view, to be discharged from the printer body and printed with the second sheet. According to this structure, the printer can successively print the paper with the first, second and third sheets by successively transporting the paper in the first and second directions.

A printer according to a second aspect of the present invention comprises a print head portion capable of emitting a laser beam for applying heat to an ink sheet thereby transferring the ink to a paper, a printer body mountable with an ink sheet cartridge for storing the ink sheet, a feed roller for transporting the paper and a head driving portion for moving the print head portion in a direction perpendicular to first and second directions for transporting the paper in plan view, while the print head portion includes a laser application portion applying the laser beam from a position separated from the paper and the ink sheet at a prescribed interval, a condenser lens for condensing the laser beam and a lens driving portion for controlling the focus of the laser beam, the ink sheet cartridge includes a first guide portion for guiding the ink sheet to come into contact with the paper and a second guide portion for guiding the paper to come into contact with the ink sheet, and the first guide portion and the second guide portion of the ink sheet cartridge include slit openings for passing the laser beam therethrough respectively, for performing printing by applying the laser beam from the laser application portion in a state bringing the ink sheet and the paper into contact with each other while transporting the ink sheet in the first direction and transporting the paper in both of the first direction and the second direction opposite to the first direction in plan view.

In the printer according to the second aspect, as hereinabove described, the printer body is rendered mountable with the ink sheet cartridge for storing the ink sheet so that the ink sheet and the paper can be separately put on standby in a nonprinting state, whereby the ink sheet and the paper do not remain in contact with each other over a long period, and the ink can be prevented from slightly adhering to the overall paper. Further, the printer comprising the print head portion including the laser application portion emitting the laser beam from the position separated from the paper and the ink sheet at the prescribed interval can apply heat without bringing the print head portion into contact with the ink sheet, to require no pressurization mechanism for applying a pressure in addition to the laser beam serving as a heat source. In addition, the printer comprises the feed roller for transporting the paper and is so formed as to perform printing by applying the laser beam from the laser application portion in the state bringing the ink sheet and the paper into contact with each other while transporting the ink sheet in the first direction and transporting the paper in both of the first direction and the second direction opposite to the first direction in plan view, to be capable of continuously performing printing by successively transporting the paper in the first and second directions when successively transferring inks from ink sheets of three colors of Y (yellow), M (magenta) and C (cyan). Thus, the printer may not transport the paper in the second direction opposite to the aforementioned first direction for returning the same to the original printing start position every time the paper is printed with one of the three colors dissimilarly to a case of performing printing by transporting the paper only in the first direction, whereby the number of times for transporting the paper in printing can be reduced. Further, the ink sheet cartridge includes the first guide portion for guiding the ink sheet to come into contact with the paper and the second guide portion for guiding the paper to come into contact with the ink sheet, whereby the ink sheet and the paper can be brought into contact with each other regularly on a constant position. The first and second guide portions of the ink sheet cartridge are so formed as to include the slit openings for passing the laser beam therethrough respectively so that the laser beam can be directly applied to the ink sheet through the slit openings, thereby easily transferring the ink to the paper by applying heat to the ink sheet and sublimating the ink. The print head portion includes the condenser lens for condensing the laser beam and the lens driving portion for controlling the focus of the laser beam so that the size of the laser beam spot can be varied by driving the condenser lens, thereby varying the size of the sublimated ink. Thus, the room for printing representation can be spread for performing high-definition printing. The print head portion includes the head driving portion for moving the print head portion in the direction perpendicular to the first and second directions for transporting the paper in plan view, so that the printer can apply the laser beam while moving the print head portion in the direction perpendicular to the first and second directions for transporting the paper in plan view, thereby performing printing also in the direction perpendicular to the directions for transporting the paper in plan view with the single laser application portion.

The aforementioned printer according to the second aspect preferably further comprises a platen roller for guiding the paper along with the second guide portion, while the platen roller is preferably so formed as to come into contact with the rear surface of the paper opposite to the front surface of the paper coming into contact with the ink sheet. According to this structure, the platen roller can prevent the paper from moving in a direction for separating from the ink sheet, thereby reliably bringing the ink sheet into contact with the paper.

In the aforementioned printer according to the second aspect, a surface of the second guide portion coming into contact with the paper preferably has a substantially planar shape. According to this structure, the paper is so guided as to come into contact with the ink sheet through the substantially planar surface of the second guide portion, whereby the second guide portion can guide the paper in a state as planar as possible without creasing the same.

In the aforementioned printer according to the second aspect, the first guide portion is preferably so formed as to extend into the slit opening of the second guide portion. According to this structure, the ink sheet is guided by the first guide portion into the slit opening of the second guide portion, to come into contact with the paper in the slit opening of the second guide portion.

In the aforementioned printer according to the second aspect, the ink sheet is preferably so guided by the first guide portion as to protrude toward the paper and come into contact with the paper in the slit opening of the second guide portion. According to this structure, the ink sheet so protrudes as to approach the paper in the slit opening of the second guide portion, thereby easily coming into contact with the paper in the slit opening of the second guide portion.

In the aforementioned printer according to the second aspect, the ink sheet is preferably formed by successively connecting at least three sheets including a first sheet, a second sheet and a third sheet, and the paper is preferably transported in the first direction to be introduced into the printer body in plan view and printed with the first sheet and the third sheet, and transported in the second direction, opposite to the first direction in plan view, to be discharged from the printer body and printed with the second sheet. According to this structure, the printer can successively print the paper with the first, second and third sheets by successively transporting the paper in the first and second directions.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

The structure of a sublimatic printer according to the embodiment of the present invention is described with reference to FIGS. 1 to 7. This embodiment of the present invention is applied to the sublimatic printer, which is an exemplary printer.

Figure 1:
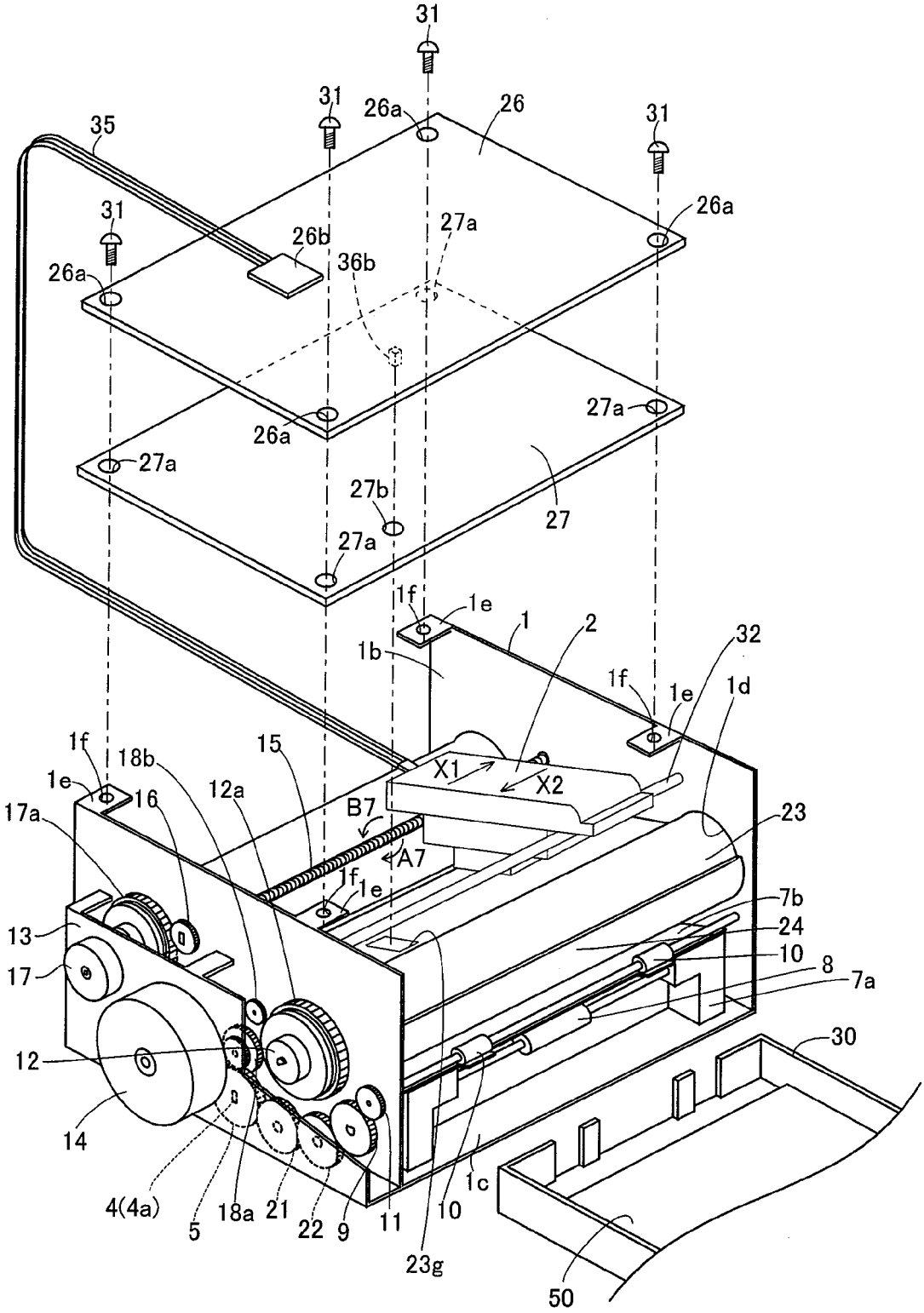
FIG. 1 is an exploded perspective view showing a sublimatic printer according to an embodiment of the present invention, from which a housing is detached.
Figure 2:
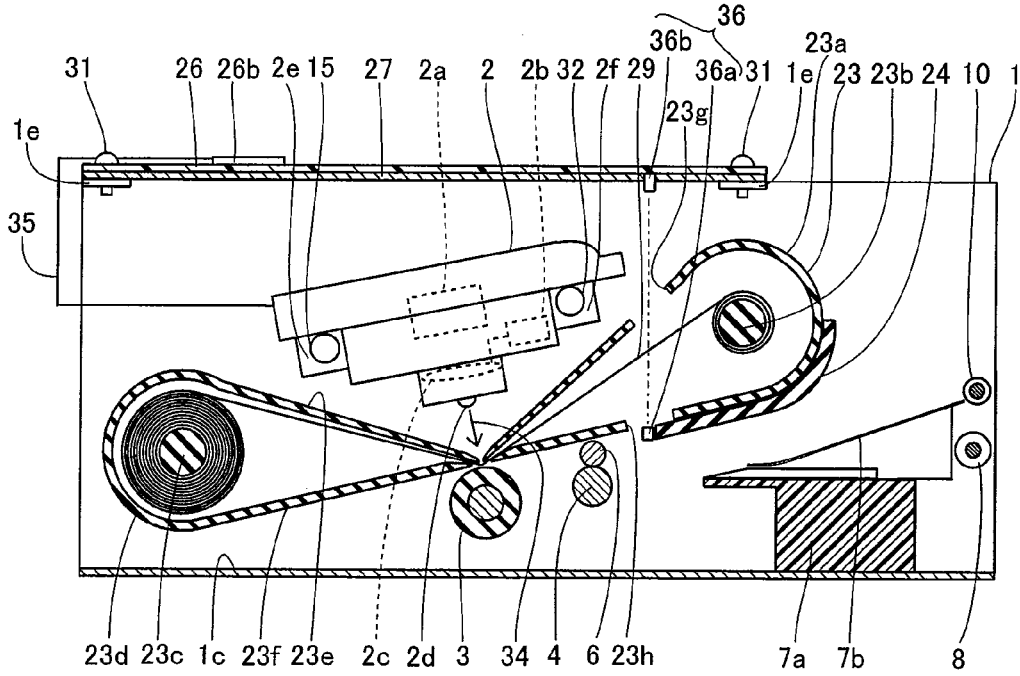
FIG. 2 is a sectional view of the sublimatic printer according to the embodiment of the present invention shown in FIG. 1.
Figure 3:
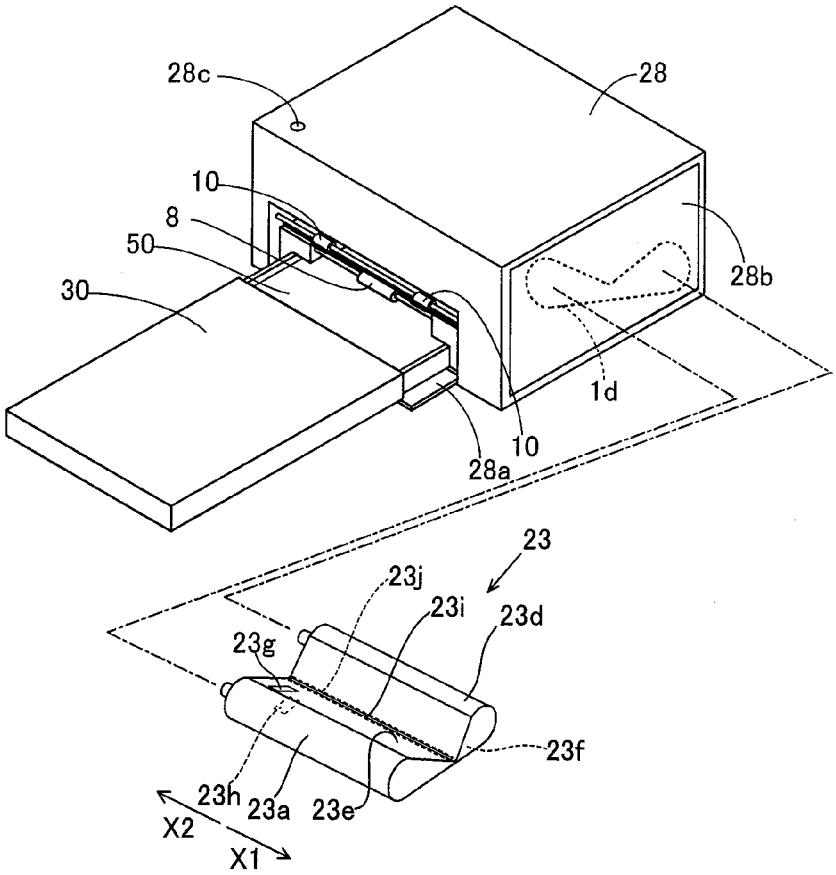
FIG. 3 illustrates the housing and an ink sheet cartridge of the sublimatic printer according to the embodiment of the present invention shown in FIG. 1.

As shown in FIG. 1, a printer body of the sublimatic printer according to the embodiment of the present invention comprises a chassis 1 of metal, a print head portion 2 for printing, a platen roller 3 (see FIG. 2) opposed to the print head portion 2, a feed roller 4 (see FIG. 2) of metal, a feed roller gear 5, a press roller 6 (see FIG. 2) of metal for pressing the feed roller 4 with prescribed pressing force, a lower paper guide 7*a* of resin, an upper paper guide 7*b* of resin, a paper feed roller 8 of rubber, a paper feed roller gear 9, a paper discharge roller 10 of rubber, a paper discharge roller gear 11, an ink sheet take-up reel 12, a motor bracket 13, a stepping motor 14 for transporting each paper 50, a lead screw 15 guiding the print head portion 2 in directions (along arrows X1 and X2) perpendicular to paper transport directions in plan view, a lead screw gear 16, a stepping motor 17 for rotating the lead screw gear 16, swingable swing gears 18*a* and 18*b*, a plurality of intermediate gears 19 to 22 (see FIG. 5), an ink sheet cartridge support portion 24 supporting an ink sheet cartridge 23, a wiring board 26 on which a circuit portion 25 (see FIG. 4) controlling operations of the sublimatic printer is packaged, a top plate 27 and a housing 28 (see FIG. 3) storing the chassis 1. The ink sheet cartridge 23 storing an ink sheet 29 capable of printing 20 papers 50 and a paper tray 30 for storing the papers 50 supplied to the sublimatic printer are detachably mounted on the sublimatic printer according to this embodiment, as shown in FIG. 2. The ink sheet cartridge 23 includes a take-up portion 23*a* for taking up the ink sheet 29 and a supply portion 23*d* for supplying the ink sheet 29, as shown in FIG. 3.

The chassis 1 has a first side surface 1*a*, a second side surface 1*b* and a bottom surface 1*c*, as shown in FIG. 1. The aforementioned motor bracket 13 is mounted on the first side surface 1*a* of the chassis 1. The second side surface 1*b* of the chassis 1 is provided with a receiving hole 1*d* for receiving the ink sheet cartridge 23. Pairs of mounting portions 1*e* for mounting the wiring board 26 are formed on the upper ends of the first and second side surfaces 1*a* and 1*b* respectively. The mounting portions 1*e* are provided with threaded holes 1*f* meshing with screws 31 for fixing the wiring board 26.

According to this embodiment, the print head portion 2 is supported by the lead screw 15 and a print head support shaft 32. This print head portion 2 includes a laser element portion 2*a*, a lens driving portion 2*b*, a condenser lens 2*c* and a laser application portion 2*d*, as shown in FIG. 2. The print head portion 2 further includes a lead screw receiving portion 2*e* having a threaded hole meshing with the lead screw 15 and a support shaft receiving portion 2*f* having a receiving hole receiving the print head support shaft 32. The lead screw 15 is inserted into the threaded hole of the lead screw receiving portion 2*e* to mesh therewith, and the print head support shaft 32 is movably inserted into the receiving hole of the support shaft receiving portion 2*f*. The laser element portion 2*a* has a function of emitting a laser beam 34 by voltage application from the laser controller 33 (see FIG. 4). The lens driving portion 2*b* has a function of varying the focus of the laser beam 34 by driving the condenser lens 2*c*. The print head portion 2 and the circuit portion 25 are electrically connected with each other through a cable 35, in order to control the laser element portion 2*a* and the lens driving portion 2*b*.

Figure 5:
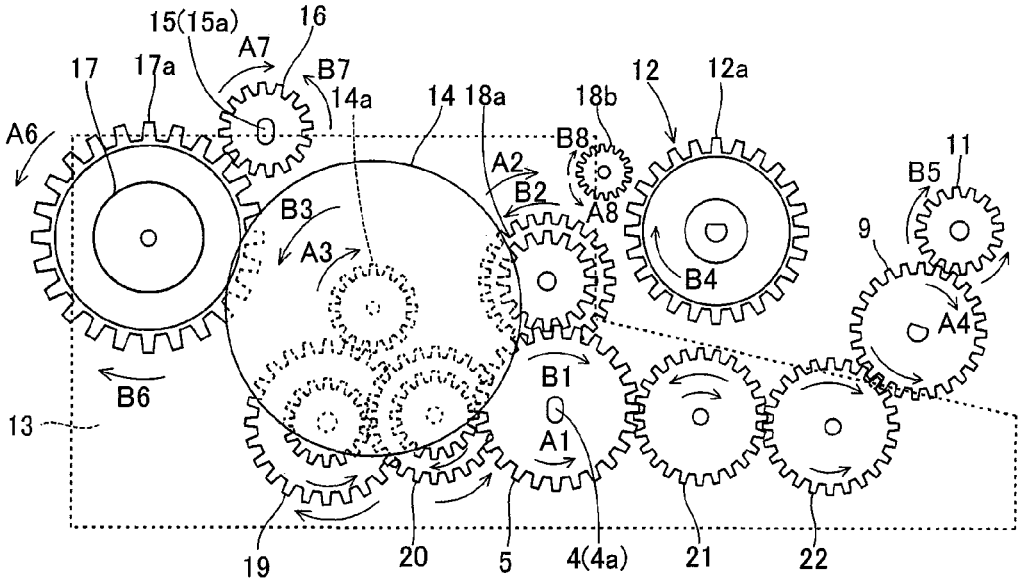
FIG. 5 illustrates arrangement of gears included in the sublimatic printer according to the embodiment of the present invention shown in FIG. 1.

The platen roller 3 is rotatably mounted on the first and second side surfaces 1*a* and 1*b* of the chassis 1 through platen roller bearings (not shown). The feed roller 4 has a feed roller insert portion 4*a* inserted into the feed roller gear 5, as shown in FIG. 5. This feed roller 4 is rotatably supported by feed roller bearings (not shown) mounted on the first and second side surfaces 1*a* and 1*b* of the chassis 1. The press roller 6 (see FIG. 2) is rotatably supported by a press roller bearing (not shown). The lead screw 15 has a lead screw insert portion 15*a* inserted into the lead screw gear 16, as shown in FIG. 5. This lead screw 15 is rotatably supported by lead screw bearings (not shown) mounted on the first and second side surfaces 1*a* and 1*b* of the chassis 1. The lead screw 15 has a screw groove so formed as to mesh with the threaded hole of the lead screw receiving portion 2*e* along the overall length. The print head support shaft 32 is supported on the first and second side surfaces 1*a* and 1*b* of the chassis 1.

As shown in FIG. 5, a motor gear 14*a* is mounted on the shaft portion of the stepping motor 14 mounted on the motor bracket 13. The stepping motor 14 functions as a driving source for driving the gear portion 12*a* of the ink sheet take-up reel 12, the paper feed roller gear 9, the paper discharge roller gear 11 and the feed roller gear 5. On the other hand, the stepping motor 17 has a motor gear 17*a*, and functions as a driving source for moving the print head portion 2 in the directions (along arrows X1 and X2 in FIG. 1) perpendicular to the paper transport directions in plan view.

The ink sheet take-up reel 12 (see FIG. 5) is so formed as to engage with a take-up bobbin 23*b* rotatably arranged in the take-up portion 23*a* of the ink sheet cartridge 23 (see FIG. 2) thereby taking up the ink sheet 29 supplied from the supply bobbin 23*c* on the take-up bobbin 23*b*. The gear portion 12*a* of the ink sheet take-up reel 12 is so arranged as to engage with the swing gear 18*a* or 18*b* upon swinging thereof, as shown in FIG. 5.

The lower paper guide 7*a* is arranged in the vicinity of the feed roller 4 and the press roller 6, as shown in FIG. 2. The upper paper guide 7*b* is mounted on an upper portion of the lower paper guide 7*a*, as shown in FIG. 2. This upper paper guide 7*b* has a function of guiding each paper 50 to a paper feed passage toward a printing portion through the lower surface thereof in paper feeding while guiding the same to a paper discharge passage through the upper surface thereof in paper discharge.

The ink sheet cartridge support portion 24 is arranged inside the first and second side surfaces 1*a* and 1*b* of the chassis 1, as shown in FIG. 1. A photoreceptive portion 36*a* of a transmission type sheet search sensor 36 is mounted on the ink sheet cartridge support portion 24. A light-emitting portion 36*b* of the sheet search sensor 36 is mounted on the wiring board 26 to be opposed to the photoreceptive portion 36*a* of sheet search sensor 36 through the ink sheet 29.

The wiring board 26 is mounted on the mounting portion le of the chassis 1 through the top plate 27, as shown in FIG. 1. More specifically, the wiring board 26 is fixed by fastening four screws 31 passed through four holes 26*a* of the wiring board 26 and four holes 27*a* of the top plate 27 to the threaded holes 1*f* of the mounting portion 1*e* of the chassis 1. An electronic component 26*b* constituting the circuit portion 25 and the light-emitting portion 36*b* of the aforementioned sheet search sensor 36 are mounted on the wiring board 26. The top plate 27 is provided with a hole 27*b* for exposing the light-emitting portion 36*b* constituting the sheet search sensor 36 mounted on the wiring board 26 toward the chassis 1.

The housing 28 includes lid members 28*a* and 28*b* and a print button 28*c*, as shown in FIG. 3. The lid member 28*a* is so provided on the housing 28 as to mount the paper tray 30 on the sublimatic printer. The other lid member 28*b* is so provided on the housing 28 as to mount the ink sheet cartridge 23 on the sublimatic printer.

According to this embodiment, the sheet search sensor 36 is so provided as to search for the ink sheet 29 by detecting respective search identification portions 29*e* to 29*h* (see FIG. 6), described later, of the ink sheet 29 arranged between the photoreceptive portion 36*a* and the light-emitting portion 36*b*, as shown in FIG. 2.

Figure 6:
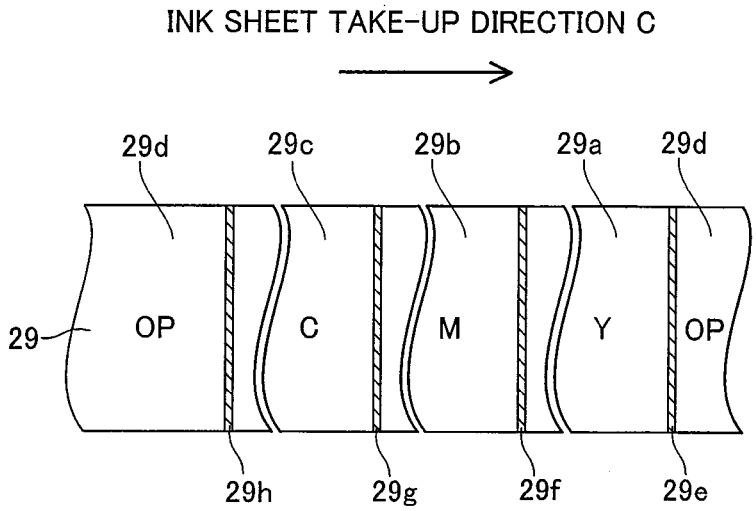
FIG. 6 is a plan view showing an ink sheet employed in the sublimatic printer according to the embodiment of the present invention shown in FIG. 1.

According to this embodiment, the supply bobbin 23*c* having the ink sheet 29 wound thereon is rotatably arranged in the support portion 23*d* of the ink sheet cartridge 23. This ink sheet 29 has 20 sets of Y (yellow) printing sheets 29*a*, M (magenta) printing sheets 29*b* and C (cyan) printing sheets 29*c* and 20 transparent OP (overcoat) sheets 29*d* successively from the side closer to the head of the ink sheet 29 along an ink sheet take-up direction, as shown in FIG. 6. The Y (yellow), M (magenta) and C (cyan) printing sheets 29*a*, 29*b* and 29*c* are examples of the "first sheet", the "second sheet" and the "third sheet" in the present invention respectively.

As shown in FIG. 6, a Y (yellow) search identification portion 29*e*, an M (magenta) search identification portion 29*f*, a C (cyan) search identification portion 29*g* and an OP (overcoat) search identification portion 29*h* are provided on the boundaries between the forward ends of each OP (overcoat) sheet 29*d*, each Y (yellow) printing sheet 29*a*, each M (magenta) sheet 29*b*, each C (cyan) printing sheet 29*c* and each OP (overcoat) sheet 29*d* respectively. Each of the search identification portions 29*e* to 29*h* is formed by a light blocking portion, and has a length of about 5 mm along the ink sheet take-up direction (along arrow C). The search identification portions 29*e* to 29*h* are so detected by the sheet search sensor 36 that the Y (yellow) printing sheet 29*a*, the M (magenta) printing sheet 29*b*, the C (cyan) printing sheet 29*c* and the OP (overcoat) sheet 29*d* are transported to printing start positions for these sheets 29*a* to 29*d* respectively.

Figure 4:
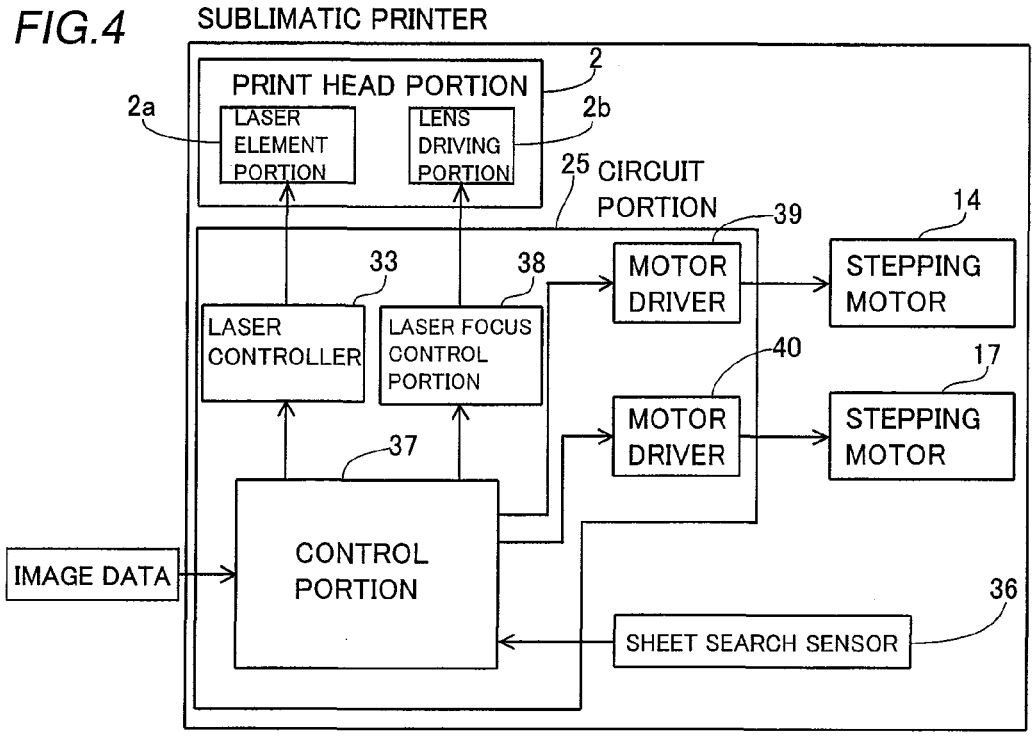
FIG. 4 is a block diagram showing the circuit structure of a circuit portion included in the sublimatic printer according to the embodiment of the present invention shown in FIG. 1.

As shown in FIG. 4, the circuit portion 25 includes a control portion 37, a laser controller 33 controlling laser application from the laser element portion 2*a* provided on the print head portion 2, a laser focus control portion 38 controlling the focus of the laser beam 34 by controlling the lens driving portion 2*b* provided on the print head portion 2, a motor driver 39 controlling the stepping motor 14 and another motor driver 40 controlling the stepping motor 17. The control portion 37 has a function of controlling the overall printing operation. The motor drivers 39 and 40 have functions of controlling rotation of the stepping motors 14 and 17 respectively.

The structure of the ink sheet cartridge 23 is now described with reference to FIGS. 2, 3 and 7.

According to this embodiment, the ink sheet cartridge 23 is provided with a pair of first guide portions 23*e* for guiding the ink sheet 29 to come into contact with each paper 50 and a pair of second guide portions 23*f* for guiding each paper 50 to come into contact with the ink sheet 29. The first and second guide portions 23*e* and 23*f* include slit openings 23*i* and 23*j* extending in the directions (along arrows X1 and X2 in FIG. 3) perpendicular to the paper transport directions in plan view respectively. The pair of first guide portions 23*e* are downwardly inclined toward the slit openings 23*i*. Further, the pair of first guide portions 23*e* are so formed as to extend into the slit openings 23*j* of the second guide portions 23*f*. Thus, the ink sheet 29 is so guided as to protrude toward the paper 50 in the slit openings 23*j* of the second guide portions 23*f*. On the other hand, surfaces of the pair of second guide portions 23*f* coming into contact with the paper 50 have a substantially planar shape. The ink sheet 29 guided by the pair of first guide portions 23*e* and exposed from the slit openings 23*i* and the paper 50 guided by the pair of second guide portions 23*f* and exposed from the slit openings 23*j* are so arranged as to come into contact with each other on the upper surface of the platen roller 3. More specifically, the front surface and the rear surface, opposite to the front surface, of the paper 50 come into contact with the ink sheet 29 and the platen roller 3 respectively in the openings 23*j* of the second guide portions 23*f*. In the paper transport directions, the slit openings 23*i* and 23*j* are set to the minimum necessary width allowing contact between the paper 50 and the ink sheet 29 and passage of the laser beam 34 applied from the laser application portion 2*d*. Thus, the area of the exposed portion of the ink sheet 29 is so reduced that the ink sheet 29 can be inhibited from deterioration. In order not to hinder sheet search operations of the light-emitting portion 36*b* and the photoreceptive portion 36*a* of the sheet search sensor 36, the first and second guide portions 23*e* and 23*f* include openings 23*g* and 23*h* respectively, as shown in FIGS. 2 and 3.

The printing operation of the sublimatic printer according to the embodiment of the present invention is described with reference to FIGS. 5, 6 and 8 to 11. According to this embodiment, the sublimatic printer performs the printing operation by transferring each paper 50 in both of directions T1 and T2 while taking up the ink sheet 29 along arrow T3. This printing operation is now described in detail.

Figure 8:
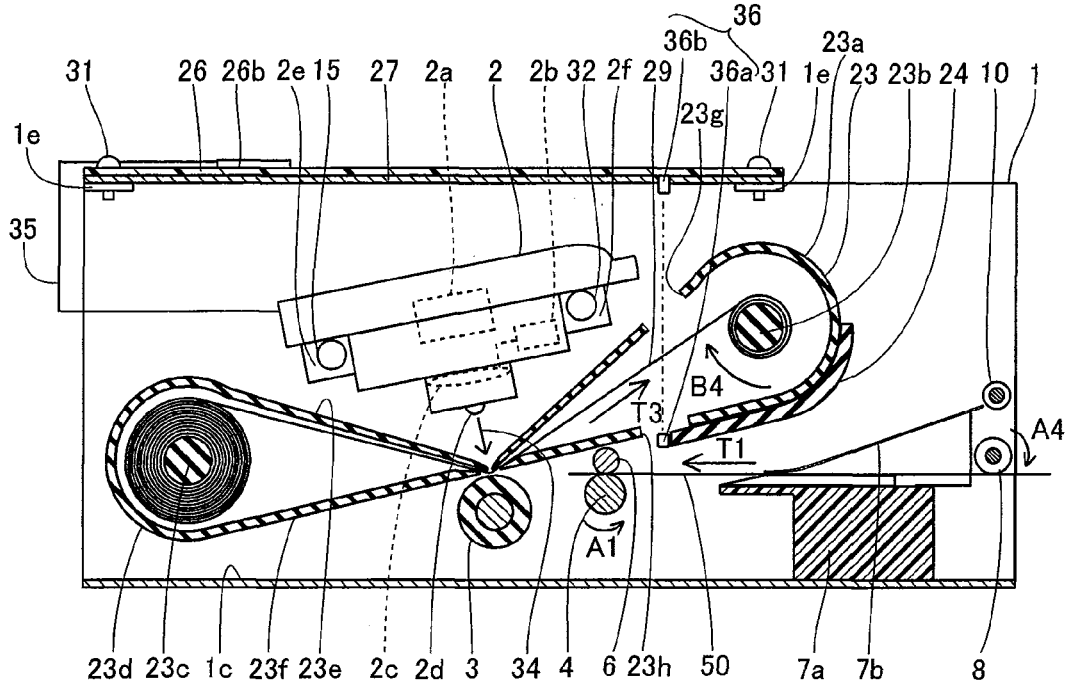
FIGS. 8 to 11 are sectional views for illustrating a printing operation in the sublimatic printer according to the embodiment of the present invention shown in FIG. 1.

When the paper 50 is fed, the stepping motor 14 is so driven that the motor gear 14*a* mounted thereon rotates along arrow A3 in FIG. 5 and the feed roller gear 5 rotates along arrow A1 through the intermediate gears 21 and 22. Following this rotation of the feed roller gear 5 along arrow A1 in FIG. 5, the paper feed roller gear 9 rotates along arrow A4 in FIG. 5 through the intermediate gears 21 and 22. Thus, the paper feed roller 8 rotates along arrow A4 in FIG. 8 as shown in FIG. 8, thereby transporting the paper 50 in contact with the lower surface of the paper feed roller 8 in a paper feed direction (along arrow T1 in FIG. 8). Consequently, the paper 50 is guided by the lower paper guide 7*a*, and transported to the printing start position by the feed roller 4 and the press roller 6, as shown in FIG. 9.

At this time, the swing gear 18*b* shown in FIG. 5 swings in an engaging direction (along arrow A8), to engage with the swing gear 18*a* and the gear portion 12*a* of the ink sheet take-up reel 12. Thus, the gear portion 12*a* of the ink sheet take-up reel 12 rotates along arrow B4, so that the ink sheet 29 is taken up on the take-up bobbin 23*b*. When the sheet search sensor 36 detects the Y (yellow) search identification portion 29*e* (see FIG. 6), the swing gear 18*b* engaging with the swing gear 18*a* and the gear portion 12*a* of the ink sheet take-up reel 12 swings in a separating direction (along arrow B8), to separate from the swing gear 18*a* and the gear portion 12*a* of the ink sheet take-up reel 12. Thus, the gear portion 12*a* of the ink sheet take-up reel 12 stops rotating, so that the ink sheet 29 is not taken up on the take-up bobbin 23*b* but only the paper 50 is transported to the printing start position shown in FIG. 9 by the feed roller 4 and the press roller 6.

Figure 9:
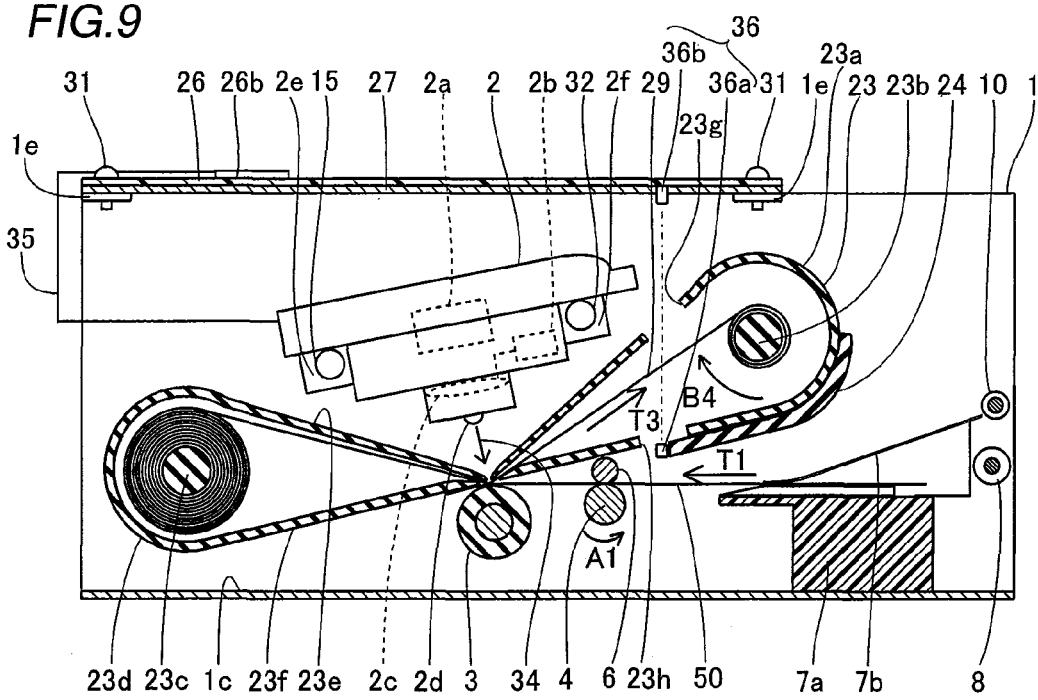
Figure 10:
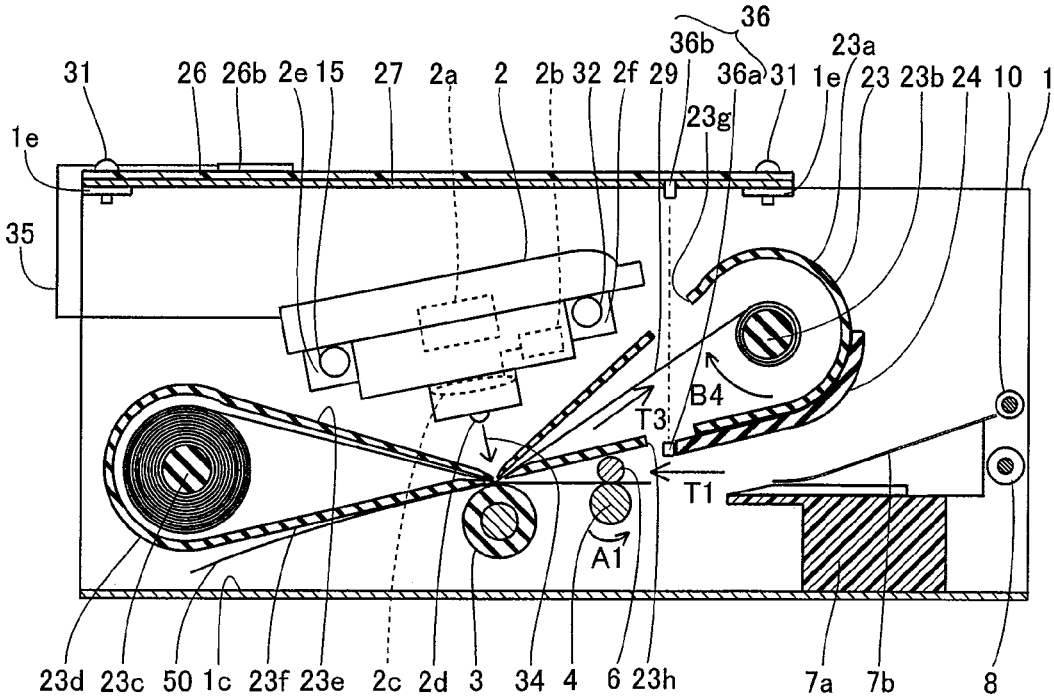
Figure 11:
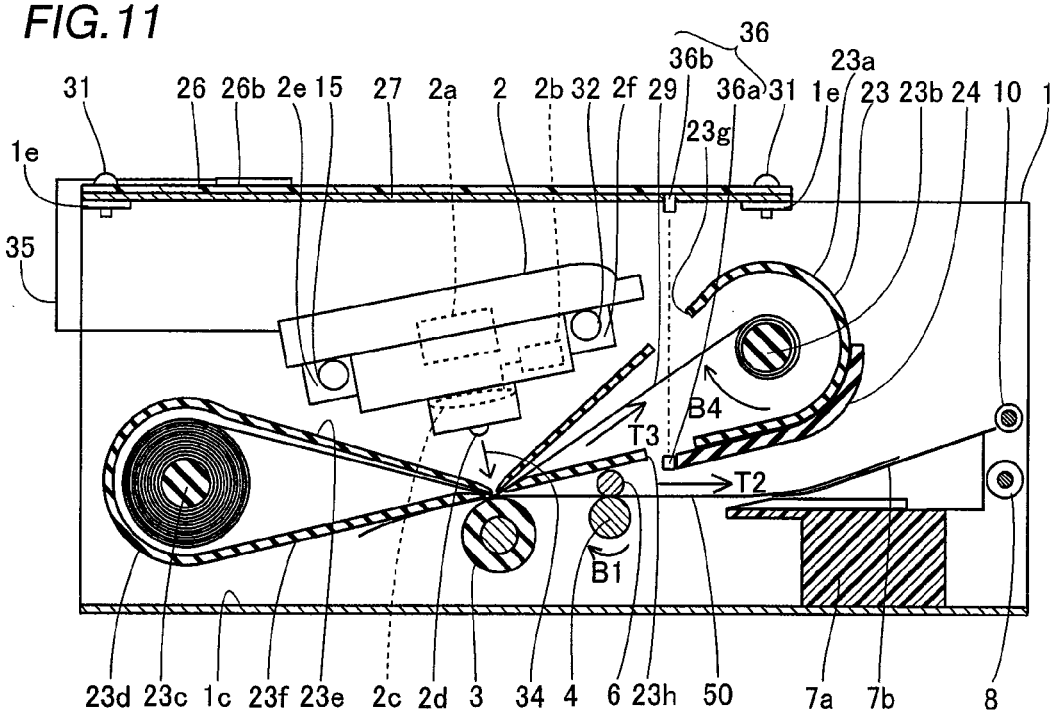

When the paper 50 is transported to the printing start position shown in FIG. 9, printing is started. In this printing, the stepping motor 14 is so driven that the motor gear 14*a* rotates along arrow A3 and the feed roller gear 5 rotates along arrow A1 through the intermediate gears 19 and 20. Thus, the feed roller 4 rotates along arrow A2, thereby transporting the paper 50 in the first paper transport direction (along arrow T1) through the slit openings 23*j* of the second guide portions 23*f* of the ink cartridge 23. At this time, the swing gear 18*b* swings in the engaging direction (along arrow A8 in FIG. 5), to engage with the swing gear 18*a* and the gear portion 12*a* of the ink sheet take-up reel 12. Thus, the gear portion 12*a* of the ink sheet take-up reel 12 rotates along arrow B4, so that the ink sheet 29 is taken up on the take-up bobbin 23*b* and transported along arrow T3 in FIG. 10. At this time, the laser beam 34 applied from the laser application portion 2*d* of the print head portion 2 heats the Y (yellow) printing sheet 29*a* and sublimates the ink thereby transferring the same to the paper 50 on the contact position between the ink sheet 29 and the paper 50. In printing with Y (yellow), the ink sheet 29 is transported along arrow T3 while the paper 50 is transported along arrow T1 opposite to the direction along arrow T3 in plan view, as described above.

Thereafter the sheet search sensor 36 detects the M (magenta) search identification portion 29*f* (see FIG. 6) of the ink sheet 29, whereby the stepping motor 14 is oppositely driven so that the motor gear 14*a* rotates along arrow B3 shown in FIG. 5 and the feed roller gear 5 rotates along arrow B1 through the intermediate gears 19 and 20. Thus, the feed roller 4 rotates along arrow B1, thereby transporting the paper 50 to the printing start position in a discharge direction (along arrow T2 in FIG. 7) opposite to the direction along arrow T1 for Y (yellow) printing. At this time, the swing gear 18*b* swings in the separating direction (along arrow B8 in FIG. 5), to separate from the swing gear 18*a* and the gear portion 12*a* of the ink sheet take-up reel 12. Further, the swing gear 18*a* swings in a separating direction (along arrow B2 in FIG. 5), to separate from the gear portion 12*a* of the ink sheet take-up reel 12. Thus, the gear portion 12*a* of the ink sheet take-up reel 12 stops rotating, so that the ink sheet 29 is not taken up on the take-up bobbin 23*b* but only the paper 50 is transported to the printing start position in the discharge direction (along arrow T2 in FIG. 11). Thus, the printing start position for the paper 50 matches with the starting position for the M (magenta) printing sheet 29*b*.

Thereafter the swing gear 18*a* swings in an engaging direction (along arrow A2 in FIG. 5), to engage with the gear portion 12*a* of the ink sheet take-up reel 12. Thus, the stepping motor 14 is so driven that the motor gear 14*a* rotates along arrow B3, and the gear portion 12*a* of the ink sheet take-up reel 12 rotates along arrow B4 through the intermediate gears 19 and 20, the feed roller gear 5 and the swing gear 18*a*. Thus, the ink sheet 29 is taken up on the take-up bobbin 23*b*, and transported along arrow T3 in FIG. 11. The paper 50 is continuously transported in the discharge direction (along arrow T2 in FIG. 11), while the ink sheet 29 and the paper 50 are transported along arrows T3 and T2 respectively. At this time, the laser beam 34 heats the M (magenta) printing sheet 29*b* to transfer the ink to the paper 50, similarly to the above. This step continues until the sheet search sensor 36 detects the C (cyan) search identification portion 29*g* (see FIG. 6) of the ink sheet 29. In printing with M (magenta), the ink sheet 29 is transported along arrow T3 while the paper 50 is transported along arrow T2 identically to the direction along arrow T3 in plan view, as described above.

Thereafter the ink is transferred from the C (cyan) printing sheet 29*c* to the paper 50, similarly to the aforementioned step of transferring the ink from the Y (yellow) printing sheet 29*a* to the paper 50. In other words, the ink sheet 29 is transported along arrow T3 while the paper 50 is transported along arrow T1 oppositely to the direction along arrow T3 in plan view, in order to perform printing in C (cyan).

Thereafter the paper 50 is coated with the OP (overcoat) sheet 29*d*, similarly to the aforementioned step of transferring the ink from the M (magenta) printing sheet 29*b* to the paper 50. In this coating with the OP (overcoat) sheet 29*d*, the ink sheet 29 is transported along arrow T3, while the paper 50 is transported along arrow T2 identically to the direction along arrow T3 in plan view.

After completely coated with the OP (overcoat) sheet 29*d*, the paper 50 is discharged from the housing 28 by the paper discharge roller 10.

An operation (scanning with the laser beam 34) of moving the print head portion 2 in the directions (along arrows X1 and X2 in FIG. 8) perpendicular to the paper transport directions (along T1 and T2 in FIG. 8) is now described with reference to FIGS. 1, 5 and 8.

The stepping motor 17 is so driven that the motor gear 17*a* mounted thereon rotates along arrow A6 and the lead screw gear 16 engaging with the motor gear 17*a* rotates along arrow A7. Thus, the lead screw 15 shown in FIG. 1 rotates along arrow A7. At this time, the lead screw receiving portion 2*e* of the print head portion 2 engages with the screw groove of the lead screw 15, so that the print head portion 2 moves along arrow X1 due to the rotation of the lead screw 15 along arrow A7. The print head portion 2 moving along arrow X1 applies the laser beam 34 toward the ink sheet 29 and the paper 50 bitwise, thereby performing printing for one line. When the printing for one line is completed, the ink sheet 29 and the paper 50 are transported by one line. Then, the scanning motor 17 is driven in the opposite direction, so that the motor gear 17*a* rotates along arrow B6 and the print head portion 2 moves along arrow X2 contrarily to the above. The print head portion 2 moving along arrow X2 applies the laser beam 34 toward the ink sheet 29 and the paper 50 bitwise, thereby performing printing for one line. When the printing for one line is completed, the ink sheet 29 and the paper 50 are transported by one line. Thereafter the aforementioned scanning movement of the laser beam 34 along arrows X1 and X2 is repeated every line. Thus, the printing is performed along arrows X1 and X2. When the print head portion 2 moves in the aforementioned directions (along arrows X1 and X2), the print head support shaft 32 and the support shaft receiving portion 2*f* (see FIG. 2) of the print head portion 2 limit movement of the print head portion 2 in directions other than those along arrows X1 and X2.

According to this embodiment, as hereinabove described, the printer body of the sublimatic printer is rendered mountable with the ink sheet cartridge 23 for storing the ink sheet 29 so that the ink sheet 29 and the paper 50 can be separately put on standby in a nonprinting state, whereby the ink sheet 29 and the paper 50 do not remain in contact with each other over a long period, and the inks can be prevented from slightly adhering to the overall paper 50. Further, the sublimatic printer comprising the print head portion 2 including the laser application portion 2*d* emitting the laser beam 34 from the position separated from the paper 50 and the ink sheet 29 at a prescribed interval can apply heat without bringing the print head portion 2 into contact with the ink sheet 29, to require no pressurization mechanism for applying a pressure in addition to the laser beam 34 serving as a heat source.

According to this embodiment, the sublimatic printer is so formed as to perform printing by applying the laser beam 34 from the laser application portion 2*d* in the state bringing the ink sheet 29 and the paper 50 into contact with each other while transporting the ink sheet 29 along arrow T3 (see FIGS. 10 and 11) and transporting the paper 50 in both of the directions along arrows T1 and T2 (see FIGS. 10 and 11) in plan view, to be capable of continuously performing printing by successively transporting the paper 50 in the directions along arrows T1 and T2 when successively transferring the inks from the Y (yellow), M (magenta) and C (cyan) printing sheets 29*a*, 29*b* and 29*c*. Thus, the sublimatic printer may not transport the paper 50 in a second direction opposite to a first direction for returning the same to the original printing start position every time the paper is printed with one of the three colors dissimilarly to a case of performing printing by transporting the paper 50 only in the aforementioned first direction, whereby the number of times for transporting the paper 50 in printing can be reduced.

According to this embodiment, the sublimatic printer includes the first guide portions 23*e* for guiding the ink sheet 29 to come into contact with the paper 50 and the second guide portions 23*f* for guiding the paper 50 to come into contact with the ink sheet 29, whereby the ink sheet 29 and the paper 50 can be brought into contact with each other regularly on a constant position.

According to this embodiment, the first and second guide portions 23*e* and 23*f* of the ink sheet cartridge 23 include the slit openings 23*i* and 23*j* for passing the laser beam 34 therethrough respectively so that the laser beam 34 can be directly applied to the ink sheet 29 through the slit openings 23*i* and 23*j*, thereby easily transferring the inks to the paper 50 by applying heat to the ink sheet 29 and sublimating the inks.

According to this embodiment, the print head portion 2 includes the condenser lens 2*c* for condensing the laser beam 34 and the lens driving portion 2*b* for controlling the focus of the laser beam 34, whereby the focus of the laser beam 34 can be so varied as to vary the size of the sublimated inks. Thus, the room for printing representation can be spread for performing high-definition printing.

According to this embodiment, the sublimatic printer is provided with a head driving portion (the lead screw 15, the lead screw receiving portion 2*e*, the lead screw gear 16, the stepping motor 17 and the motor gear 17*a*) for moving the print head portion 2 along arrows X1 and X2 (see FIG. 1) to be capable of applying the laser beam 34 while moving the print head portion 2 along arrows X1 and X2, thereby performing printing also in the directions (along arrows X1 and X2 in FIG. 1) perpendicular to the paper transport directions (along arrows T1 and T2 in FIGS. 10 and 11) in plan view with the single laser application portion 2*d*.

According to this embodiment, the sublimatic printer is further provided with the platen roller 3 for guiding the paper 50 along with the second guide portions 23*f* to come into contact with the rear surface of the paper 50 opposite to the front surface coming into contact with the ink sheet 29 for inhibiting the paper 50 from moving in a direction for separating from the ink sheet 29, whereby the ink sheet 29 can reliably come into contact with the paper 50.

According to this embodiment, the ink sheet 29 is so guided by the first guide portions 23*e* as to protrude toward the paper 50 and come into contact therewith in the slit openings 23*j* of the second guide portions 23*f* so that the ink sheet 29 so protrudes as to approach the paper 50 in the slit openings 23*j* of the second guide portions 23*e*, thereby easily coming into contact with the paper 50 in the slit openings 23*j* of the second guide portions 23*f*.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is applied to the sublimatic printer employed as an exemplary printer, the present invention is not restricted to this but is also applicable to a printer other than the sublimatic printer, so far as the printer comprises a laser application portion provided on a print head portion.

While the head driving portion is provided with the lead screw for moving the print head portion in the directions perpendicular to the paper transport directions in plan view in the aforementioned embodiment, the present invention is not restricted to this but the printer may alternatively be provided with driving means having another structure.

While the print head portion includes only one condenser lens in the aforementioned embodiment, the present invention is not restricted to this but the print head portion may alternatively include a plurality of condenser lenses.

While the Y (yellow), M (magenta), C (cyan) and OP (overcoat) sheets are successively arranged on the ink sheet in the aforementioned embodiment, the present invention is not restricted to this but individual ink sheets may alternatively be employed for the respective colors.

Figure 7:
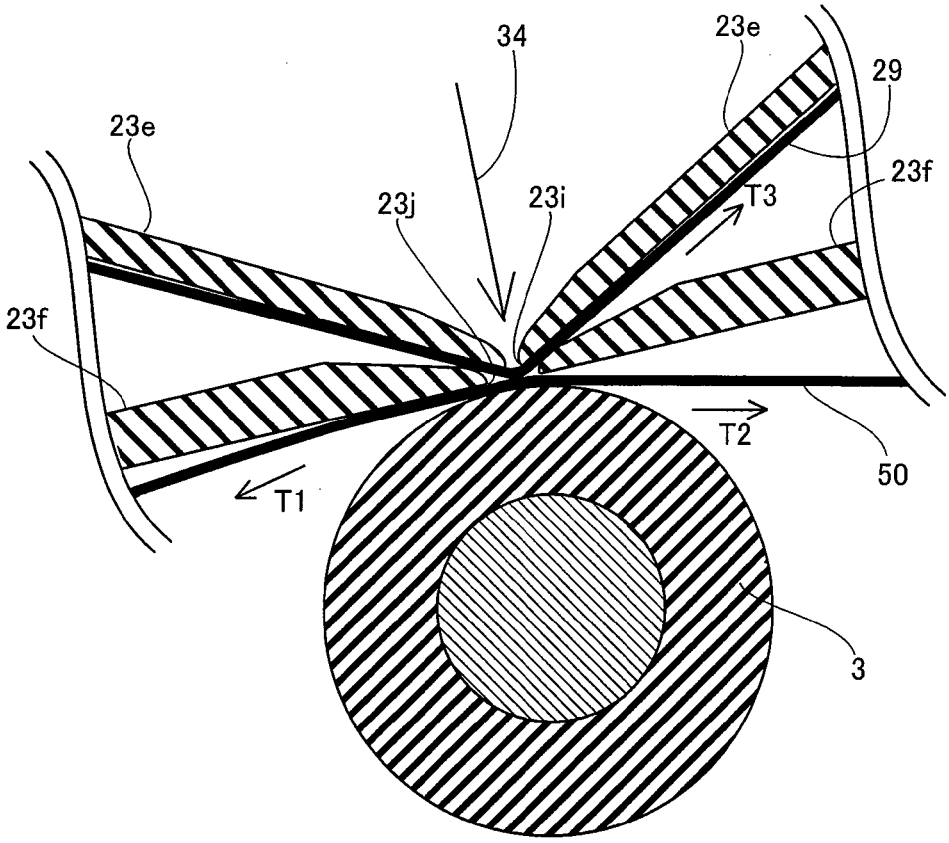
FIG. 7 illustrates contact between the ink sheet and a paper in the sublimatic printer according to the embodiment of the present invention shown in FIG. 1.

While the first and second guide portions of the ink sheet cartridge have the shape shown in FIG. 7 in the aforementioned embodiment, the present invention is not restricted to this but each of the first and second guide portions may have another shape so far as the same can bring the ink sheet and the paper into contact with each other so that the laser beam is applicable to the contact position therebetween and can transport the ink sheet and the paper in directions opposite to each other in plan view in the contact state.

What is claimed is:

1. A printer comprising:

a printer body mountable with an ink sheet cartridge for storing an ink sheet;

a print head portion, provided on said printer body, including a laser application portion emitting a laser beam from a position separated from a paper and said ink sheet at a prescribed interval for applying heat to said ink sheet thereby transferring the ink to said paper; and a feed roller for transporting said paper, for performing printing by applying said laser beam from said laser application portion in a state bringing said ink sheet and said paper into contact with each other while transporting said ink sheet in a first direction and transporting said paper in both of said first direction and a second direction opposite to said first direction in plan view, wherein said ink sheet cartridge includes a first guide portion for guiding said ink sheet to come into contact with said paper and a second guide portion for guiding said paper to come into contact with said ink sheet;

said first guide portion and said second guide portion of said ink sheet cartridge include slit openings for passing said laser beam therethrough respectively; and said slit openings including a first slit opening and a second slit opening that are overlapped with each other.

2. The printer according to claim 1, further comprising a platen roller for guiding said paper along with said second guide portion, wherein said platen roller is so formed as to come into contact with the rear surface of said paper opposite to the front surface of said paper coming into contact with said ink sheet.

3. The printer according to claim 1, wherein a surface of said second guide portion coming into contact with said paper has a substantially planar shape.

4. The printer according to claim 1, wherein said first guide portion is so formed as to extend into said slit opening of said second guide portion.

5. The printer according to claim 1, wherein said ink sheet is so guided by said first guide portion as to protrude toward said paper and come into contact with said paper in said slit opening of said second guide portion.

6. The printer according to claim 1, wherein said print head portion includes a condenser lens for condensing said laser beam and a lens driving portion for controlling the focus of said laser beam.

7. The printer according to claim 1, further comprising a head driving portion provided on said printer body for moving said print head portion in a direction perpendicular to said first and second directions for transporting said paper in plan view.

8. The printer according to claim 1, wherein said ink sheet is formed by successively connecting at least three sheets including a first sheet, a second sheet and a third sheet, and said paper is transported in said first direction to be introduced into said printer body in plan view and printed with said first sheet and said third sheet, and transported in said second direction, opposite to said first direction in plan view, to be discharged from said printer body and printed with said second sheet.

9. A printer comprising:

a print head portion capable of emitting a laser beam for applying heat to an ink sheet thereby transferring the ink to a paper;

a printer body mountable with an ink sheet cartridge for storing said ink sheet;

a feed roller for transporting said paper; and a head driving portion for moving said print head portion in a direction perpendicular to first and second directions for transporting said paper in plan view, wherein said print head portion includes a laser application portion applying said laser beam from a position separated from said paper and said ink sheet at a prescribed interval, a condenser lens for condensing said laser beam and a lens driving portion for controlling the focus of said laser beam, said ink sheet cartridge includes a first guide portion for guiding said ink sheet to come into contact with said paper and a second guide portion for guiding said paper to come into contact with said ink sheet, said first guide portion and said second guide portion of said ink sheet cartridge include slit openings for passing said laser beam therethrough respectively, and said slit openings including a first slit opening and a second slit opening that are overlapped with each other, for performing printing by applying said laser beam from said laser application portion in a state bringing said ink sheet and said paper into contact with each other while transporting said ink sheet in said first direction and transporting said paper in both of said first direction and said second direction opposite to said first direction in plan view.

10. The printer according to claim 9, further comprising a platen roller for guiding said paper along with said second guide portion, wherein said platen roller is so formed as to come into contact with the rear surface of said paper opposite to the front surface of said paper coming into contact with said ink sheet.

11. The printer according to claim 9, wherein a surface of said second guide portion coming into contact with said paper has a substantially planar shape.

12. The printer according to claim 9, wherein said first guide portion is so formed as to extend into said slit opening of said second guide portion.

13. The printer according to claim 9, wherein said ink sheet is so guided by said first guide portion as to protrude toward said paper and come into contact with said paper in said slit opening of said second guide portion.

14. The printer according to claim 9, wherein said ink sheet is formed by successively connecting at least three sheets including a first sheet, a second sheet and a third sheet, and said paper is transported in said first direction to be introduced into said printer body in plan view and printed with said first sheet and said third sheet, and transported in said second direction, opposite to said first direction in plan view, to be discharged from said printer body and printed with said second sheet.

* * * * *